US009399540B2

(12) United States Patent
Bushman et al.

(10) Patent No.: US 9,399,540 B2
(45) **Date of Patent: *Jul. 26, 2016**

(54) STORING AND DISPENSING CONTAINER FOR PRODUCT HAVING IMPROVED DISPENSING ORIFICE

(75) Inventors: Lisa L. Bushman, Kaukauna, WI (US); Paul W. Christoffel, Appleton, WI (US); Lawrence J. Romano, III, Appleton, WI (US); Zachary J. Lee, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 986 days.

This patent is subject to a terminal disclaimer.

(21) Appl. No.: 13/545,451

(22) Filed: Jul. 10, 2012

(65) Prior Publication Data

US 2014/0001196 A1 Jan. 2, 2014

Related U.S. Application Data

(63) Continuation-in-part of application No. 13/538,356, filed on Jun. 29, 2012.

(51) Int. Cl.

| | |
|---|---|
| ***A47K 10/42*** | (2006.01) |
| ***B65D 75/58*** | (2006.01) |
| ***B65D 83/08*** | (2006.01) |

(52) U.S. Cl.

CPC ..... *B65D 75/5833* (2013.01); *B65D 83/08* (2013.01)

(58) Field of Classification Search

CPC ..... B65D 75/5833; B65D 83/08
USPC ..... 221/32, 45, 50
See application file for complete search history.

(56) References Cited

U.S. PATENT DOCUMENTS 3,002,668 A * 10/1961 Castelli ..... A47K 10/20 221/63
3,265,242 A * 8/1966 Davis ..... B65D 83/0811 221/48

(Continued)

FOREIGN PATENT DOCUMENTS

EP 1 862 396 A1 12/2007
GB 2 451 742 A1 2/2009

(Continued)

OTHER PUBLICATIONS 4 photographs of package of Kirkland Signature baby wipes purchased in the United States Jun. 2012.

(Continued)

*Primary Examiner* — Michael K Collins
(74) *Attorney, Agent, or Firm* — Kimberly-Clark Worldwide, Inc.

(57) ABSTRACT

A dispensing container includes a plurality of sheets of products stored within a housing. The container includes a dispensing orifice having a length that extends along a longitudinal axis from a first end to a second end. In particular embodiments, the dispensing orifice has a maximum width disposed not less than 20% and not more than 49% of the distance from the first end to the second end, a midpoint width disposed halfway between the first end and the second end, the midpoint width being less than the maximum width, and a third width disposed 80% of the distance from the first end to the second end, the third width being no greater than 80% of the maximum width. In particular embodiments, the dispensing orifice is symmetrical about a longitudinal axis but asymmetrical about a transverse axis. In particular embodiments, the dispensing orifice has an ovoid shape.

16 Claims, 12 Drawing Sheets

(56) References Cited

U.S. PATENT DOCUMENTS

| | | | | |
|---|---|---|---|---|
| 3,458,080 | A | 7/1969 | Laurizio | |
| 3,666,140 | A * | 5/1972 | Brefka | B65D 83/0823 206/449 |
| 4,462,507 | A | 7/1984 | Margulies | |
| 4,570,820 | A * | 2/1986 | Murphy | B65D 33/24 206/210 |
| 4,785,970 | A * | 11/1988 | Engelmayer | B65D 83/0805 221/47 |
| 4,979,613 | A * | 12/1990 | McLaughlin | B65D 33/24 206/233 |
| 5,379,897 | A | 1/1995 | Muckenfuhs et al. | |
| 5,704,471 | A | 1/1998 | Yamada | |
| 5,918,735 | A | 7/1999 | Bando et al. | |
| 6,053,357 | A * | 4/2000 | Yoh | B65D 83/0805 206/494 |
| 6,113,271 | A | 9/2000 | Scott et al. | |
| 6,267,262 | B1 * | 7/2001 | Wilner | B65D 83/0805 221/45 |
| 6,309,105 | B1 | 10/2001 | Palumbo | |
| 6,409,044 | B1 | 6/2002 | Brown et al. | |
| 6,420,006 | B1 | 7/2002 | Scott | |
| 6,499,626 | B1 | 12/2002 | Julius | |
| 6,589,622 | B1 | 7/2003 | Scott | |
| 6,604,628 | B1 | 8/2003 | Tanaka et al. | |
| 6,616,189 | B2 | 9/2003 | Raming | |
| 6,964,349 | B2 * | 11/2005 | Sears | A47K 10/421 206/494 |
| 7,143,906 | B2 | 12/2006 | Chasid et al. | |
| 7,172,093 | B2 | 2/2007 | Bando | |
| 7,241,066 | B1 | 7/2007 | Rosen et al. | |
| 7,303,092 | B2 * | 12/2007 | Sarbo | A47K 10/421 221/46 |
| 7,571,832 | B2 | 8/2009 | Mark et al. | |
| 7,665,629 | B2 | 2/2010 | Julius et al. | |
| 7,703,602 | B2 | 4/2010 | Saito et al. | |
| 7,922,036 | B2 | 4/2011 | Bendor et al. | |
| 7,997,444 | B2 * | 8/2011 | Martins | B65D 47/0804 221/303 |
| 8,408,792 | B2 * | 4/2013 | Cole | B65D 75/5838 383/106 |
| 8,499,959 | B2 * | 8/2013 | Chasid | B65D 75/5838 206/233 |
| 8,646,653 | B2 * | 2/2014 | Lien | B65D 5/542 206/494 |
| 2002/0068142 | A1 | 6/2002 | Baroni et al. | |
| 2003/0111378 | A1 | 6/2003 | Huang et al. | |
| 2005/0011906 | A1 * | 1/2005 | Buck | B65D 75/5833 221/64 |
| 2005/0205593 | A1 | 9/2005 | Young et al. | |
| 2005/0211716 | A1 | 9/2005 | Decker et al. | |
| 2006/0151515 | A1 | 7/2006 | Hood et al. | |
| 2007/0210096 | A1 * | 9/2007 | Ellswood | B65D 83/0805 221/34 |
| 2007/0233031 | A1 * | 10/2007 | Benson | B65D 75/5833 604/385.02 |
| 2008/0240627 | A1 * | 10/2008 | Cole | B65D 75/5838 383/204 |
| 2008/0253697 | A1 | 10/2008 | O'Neill et al. | |
| 2009/0014459 | A1 | 1/2009 | Hood et al. | |
| 2009/0261001 | A1 * | 10/2009 | Yao | A61B 19/045 206/223 |
| 2009/0273179 | A1 | 11/2009 | Scott et al. | |
| 2010/0308072 | A1 | 12/2010 | Hood et al. | |
| 2011/0147401 | A1 * | 6/2011 | Rubo | B65D 75/5838 221/1 |
| 2012/0074142 | A1 | 3/2012 | Mays et al. | |
| 2014/0001072 | A1 * | 1/2014 | Christoffel | B65D 75/5833 206/459.5 |
| 2014/0001196 | A1 * | 1/2014 | Bushman | B65D 75/5833 221/45 |

FOREIGN PATENT DOCUMENTS

| | | | |
|---|---|---|---|
| JP | 09-216672 | A | 8/1997 |
| JP | 11-292117 | A | 10/1999 |
| JP | 2001-269282 | A | 10/2001 |
| WO | WO 00/64755 | A2 | 11/2000 |
| WO | WO 2005/112556 | A2 | 12/2005 |
| WO | WO 2009/126081 | A1 | 10/2009 |
| WO | WO 2011/024002 | | 3/2011 |

OTHER PUBLICATIONS 4 photographs of package of Pampers Sensitive wipes purchased in the United States Jun. 2012.

4 photographs of package of Target Up & Up baby wipes purchased in the United States Jun. 2012.

* cited by examiner

STORING AND DISPENSING CONTAINER FOR PRODUCT HAVING IMPROVED DISPENSING ORIFICE

This application is a continuation-in-part of application Ser. No. 13/538,356 filed on Jun. 29, 2012. The entirety of application Ser. No. 13/538,356 is hereby incorporated by reference.

BACKGROUND OF THE INVENTION

There are a variety of storing and dispensing containers in the market, particularly those for storing and dispensing wipe type products. Wipe type products or wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes each folded wet wipe is interfolded with the wet wipes immediately above and below it in the stack of wipes. In an alternative configuration, the wet wipes have been placed in a container in the form of a continuous web of material that includes perforations adapted to allow for separation of individual wet wipes from the web upon the application of a pulling force. Such wet wipes have been used for baby wipes, hand wipes, personal care wipes, household cleaning wipes, industrial wipes and the like.

Conventional packages of wipes have typically been designed to be positioned on a flat surface such as a countertop, table or the like. Such conventional packages have often included a plastic container, tub or package which provides a sealed environment for the wet wipes to ensure that they do not become dirty or overly dry. Some of the conventional packages have also been configured to provide "one-at-a-time" dispensing of each wet wipe which can be accomplished using a single hand after the package has been opened. Such single-handed, one-at-a-time dispensing is particularly desirable because the other hand of the user or care giver is typically required to be simultaneously used for other functions. For example, when changing a diaper product on an infant, the care giver typically uses one hand to hold and maintain the infant in a desired position while the other hand is used to dispense a baby wipe to clean the infant.

"Pop-up" configurations of wet wipe dispensers can advantageously help provide the aforementioned single-handed, "one-at-a-time" dispensing. In "pop-up" configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes the leading wipe.

Historically, two malfunctions can occur during the operation just described. In one scenario, as the leading wipe is withdrawn, the leading wipe may not properly release from the succeeding wipe, with the result that the succeeding wipe is pulled too far or even entirely out of the package. A situation in which one or more succeeding wipes are in a single pull operation withdrawn from the package by virtue of being in operative contact with the leading wipe is referred to herein as "multiples." Multiples can result from excessively strong connections between successive wipes (e.g., too much adhesive or insufficient web perforations), or can result from a dispensing orifice that does not sufficiently hold in place the succeeding wipe to allow the leading wipe to break free (e.g., too large of a dispensing orifice).

In another scenario, as the leading wipe is withdrawn, the succeeding wipe, after breaking free from the leading wipe, may not be readily accessible for subsequent dispensing. For example, although the leading end of the succeeding wipe may momentarily protrude from the package as it follows the leading wipe during withdrawal of the leading wipe, the leading end of the succeeding wipe often subsequently falls back through the dispensing orifice into the dispensing container—herein referred to as a "fallback." Fallbacks can result from insufficiently strong connections between successive wipes (i.e., not enough adhesive or an excessively weak line of weakness), or can result from a dispensing orifice that does not sufficiently hold the leading edge of the succeeding wipe in an outwardly protruding manner (i.e., too large of a dispensing orifice).

The aforementioned malfunctions can to some extent be remedied by employing a relatively small dispensing orifice, such as, for example, a circle approximately one centimeter in diameter. However, relatively small dispensing orifices present a problem. In the event that a fallback does occur, a user must have the ability to access the remaining wipes inside the package. It has been discovered that it is difficult for the human hand, or even a human finger, to fit through many conventional, relatively small dispensing orifices to grasp the top wipe within the package following a fallback.

As a result, what is lacking in the art is a dispensing orifice that is shaped and sized small enough to help prevent multiples and fallbacks, but that is shaped and sized large enough to provide for ready access to the first wipe in the package and to remaining wipes in the package following fallbacks.

Furthermore, many prior art wipes packages include a flexible pouch to which a rigid closed-loop flange is attached. A rigid flip top is commonly hingedly attached to the flange. Within the closed-loop flange, the flexible pouch commonly includes a removable portion. The removable portion can be peeled away to define a dispensing orifice. Commonly, the closed-loop flange and rigid flip top define within their perimeter an area in the range of approximately 40 to 70 square centimeters. Such dimensions are desirable both ergonomically and aesthetically. In certain prior art embodiments, the removable portion within the flange abuts the flange around the entire perimeter of the removable portion (see FIG. 1A). In other prior art embodiments, the removable portion does not abut the flange around any of the perimeter of the removable portion (see FIG. 1B). In such embodiments, the removable portion is positioned in the center of the inner area defined by the closed-loop flange, as shown in FIGS. 1A and 1B.

One problem with positioning a relatively small removable portion in the center of the inner area defined by a closed-loop flange is that as the removable portion is removed, the flexible pouch can tear in an undesirable manner. Furthermore, it can be difficult to provide clear, understandable instructions for removing the removable portion entirely within the area surrounded by the closed-loop flange if the removable portion is positioned squarely in the center of such area.

As a result, what is further lacking in the art is an approach to provide a flexible pouch with a removable portion that when removed does not tear the pouch in an undesirable manner, and which provides clear, understandable instructions coordinated with the structure of the removable portion and the flange.

SUMMARY OF THE INVENTION

In response to the aforementioned needs, a new storing and dispensing container for a plurality of sheets of product has been invented. In particular embodiments, the container includes a housing for storing product. The housing includes a bottom portion with side portions adjoined to the bottom portion and each side portion adjoined to an adjacent side portion and the side portions extending away from the bottom portion. The side portions are also adjoined to a top portion with the top portion overlying the bottom portion and being generally parallel to the bottom portion. The plurality of sheets is positioned within the housing. The container includes a dispensing orifice in the top portion, and the dispensing orifice has a length that extends along a longitudinal axis from a first end to a second end.

In particular embodiments, the dispensing orifice has a maximum width disposed not less than 20% and not more than 49% of the distance from the first end to the second end. The dispensing orifice further has a midpoint width disposed halfway between the first end and the second end, the midpoint width being less than the maximum width. The dispensing orifice further has a third width disposed 80% of the distance from the first end to the second end, the third width being no greater than 80% of the maximum width.

In particular embodiments, the length of the dispensing orifice defines a longest dimension of the dispensing orifice. The dispensing orifice has a transverse axis disposed halfway between the first end and the second end, and the transverse axis extends perpendicularly to the longitudinal axis. The dispensing orifice is symmetrical about the longitudinal axis but asymmetrical about the transverse axis.

In particular embodiments, the dispensing orifice has an ovoid shape.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the containers and packages of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the packages depicted in the drawings are referred to by the same reference numerals.

DETAILED DESCRIPTION OF THE INVENTION

Figure 1A:
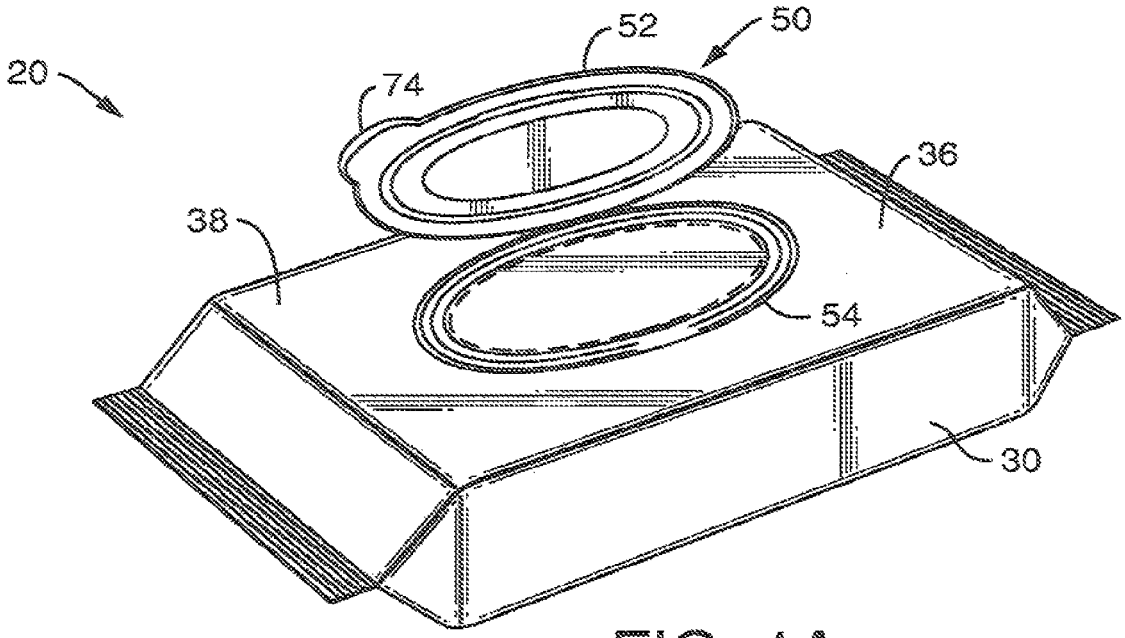
FIG. 1A (PRIOR ART)
FIGS. 1A and 1B representatively show two prior art configurations of flexible pouch, rigid flip top wet wipes dispensers.
Figure 1B:
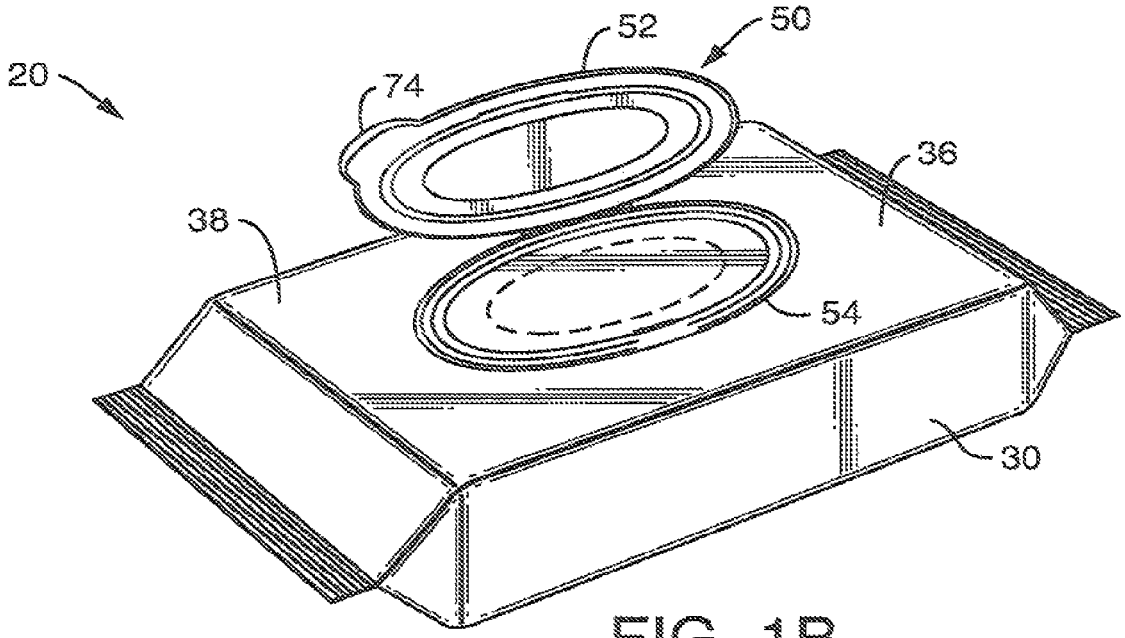
FIG. 1B (PRIOR ART)

As used herein, "flexible" means a non-foamed polymeric containing film with a thickness of about 250 micrometers or less or a foamed polymeric containing film with a thickness of about 2000 micrometers or less.

As used herein, "rigid" means a level of stiffness commonly associated with materials used to manufacture wet wipes tubs of parts thereof. Numerically, these materials typically have a flexural modulus (as measured in accordance with ASTM D790 "Standard Test Method for Flexural Properties of Unreinforced and Reinforced Plastics and Electrical Insulating Materials") of about 100 Newtons per square millimeter or greater, more specifically from about 1100 to about 1550 Newtons per square millimeter.

The present invention is directed at solving problems related to storing and dispensing product such as wipes and wet wipes from containers, and to solving problems related to the initial opening of such containers. As representatively illustrated throughout FIGS. 2-19, the present invention provides a storing and dispensing container 20 for product 22. Product 22 could be a variety of pliable type items, such as wipes, wet wipes, or other items where single-unit dispensing is desired. The container 20 generally includes a housing, such as a flexible pouch 30, for storing product 22, and in particular embodiments, can further include a rigid flip top 50 for dispensing the product and then resealing the container. The housing can be rigid (such as a plastic tub) or flexible (such as a pouch 30). The housing, such as a pouch 30, includes a bottom portion 32 with side portions 34 adjoined to the bottom portion 32 and each side portion adjoined to an adjacent side portion and the side portions extending away from the bottom portion. As seen in the Figures, the pouch is in particular embodiments rectangular; however, it could be a variety of other shapes as long as there is a bottom adjoined to at least one side (e.g., the side being a cylinder). The side portions 34 are also adjoined to a top portion 36 with the top portion 36 overlying the bottom portion 32. Advantageously, the top portion 36 can be generally parallel to the bottom portion 32, but need not be. In particular embodiments, the top portion 36 includes a removable portion 40 which seals the product 22 within the pouch 30 in a first condition (as seen in FIG. 2, i.e., before the product is dispensed the first time) and which allows access to the product within the pouch in a second condition (i.e., when the removable portion 40 is removed and the rigid flip top 50 is in an open condition, as shown in FIG. 10C).

Figure 2:
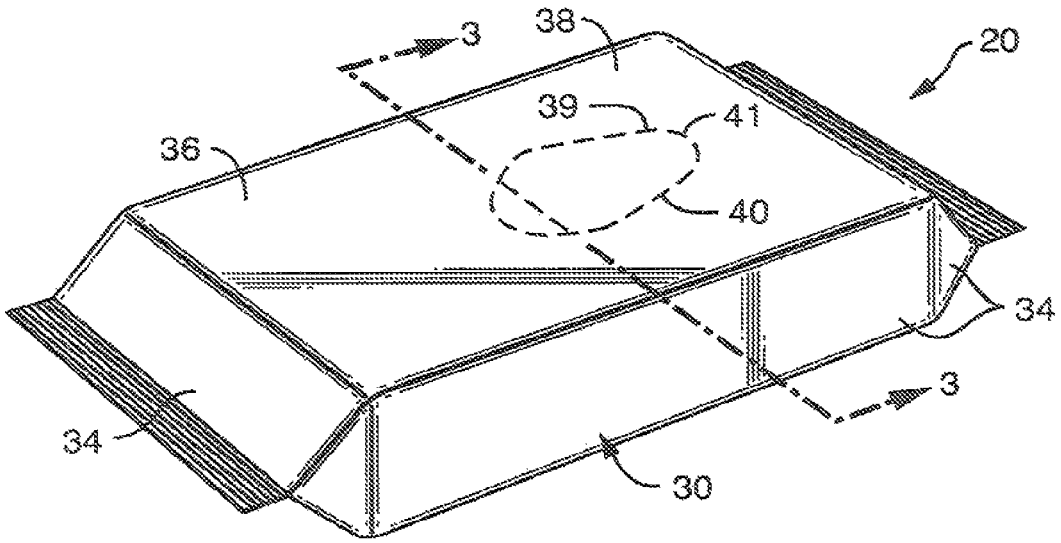
FIG. 2 representatively shows a perspective view of a flexible pouch for product such as wipes, with a removable portion shown in dotted lines sealing the product within the pouch.
Figure 3:
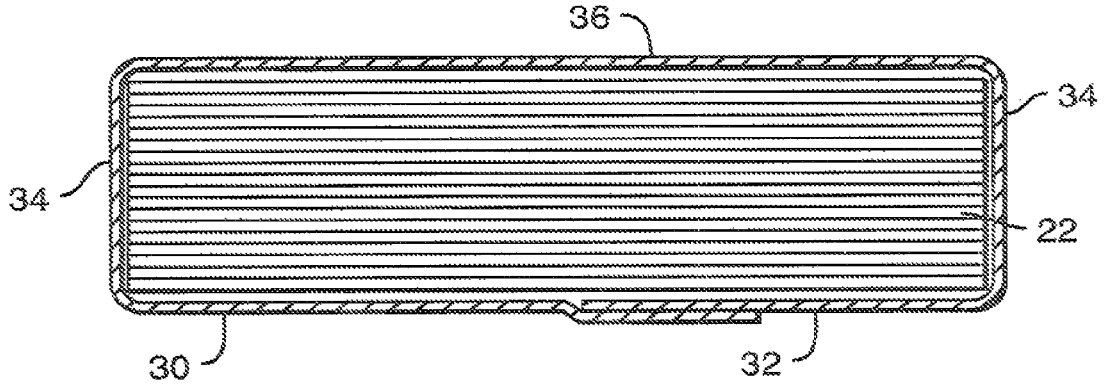
FIG. 3 representatively shows a cross-sectional view of the container for wipes illustrated in FIG. 1 with a stack of wipes therein, taken along the line 3-3.
Figure 9:
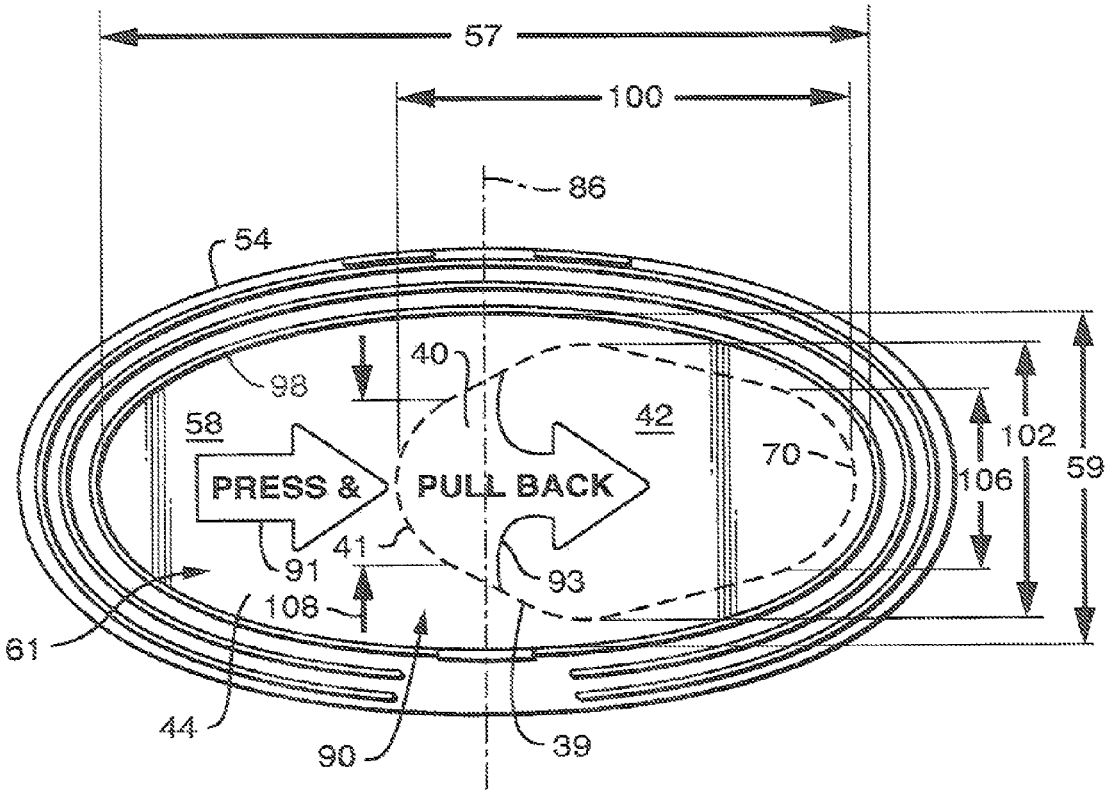
FIG. 9 representatively shows an enlarged view of the top portion of a pouch surrounded by a flange in accordance with one embodiment of the present invention.

Referring to FIGS. 2, 9, and 10, the removable portion 40 of the pouch 30 may in particular embodiments be defined by a frangible line of weakness 39. Such line of weakness 39 can take the form of a line of intermittent perforations, such as a line of perforations provided by a die cutter, or can comprise a scored line formed in the pouch 30. The removable portion 40 is adapted to be pulled off, peeled away, or otherwise removed from the pouch 30 to reveal a dispensing orifice 82, through which wipes or other product can be withdrawn from the container 20. The removable portion 40 defines a perimeter 41. In particular embodiments, the frangible line of weakness 39 defines the perimeter 41 of the removable portion 40. The removable portion 40 further defines a removable portion area 42—namely, the area with the boundary of the removable portion perimeter 41. Optionally, the removable portion 40 can be overlaid by a label, such as an adhesively attached label, which can be configured to be either resealable or configured to be disposed of immediately after the initial opening of the pouch.

Figure 4:
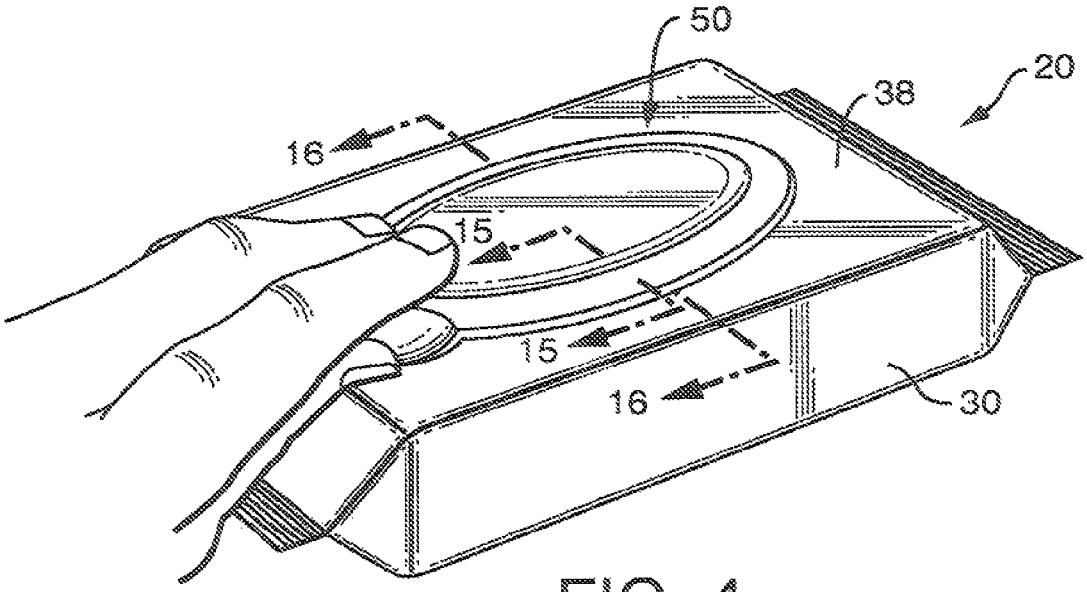
FIG. 4 representatively shows a perspective view of an example of a container for wipes suitable for use in conjunction with particular embodiments of the present invention as a user is about to move the lid from being closed to being open.
Figure 5:
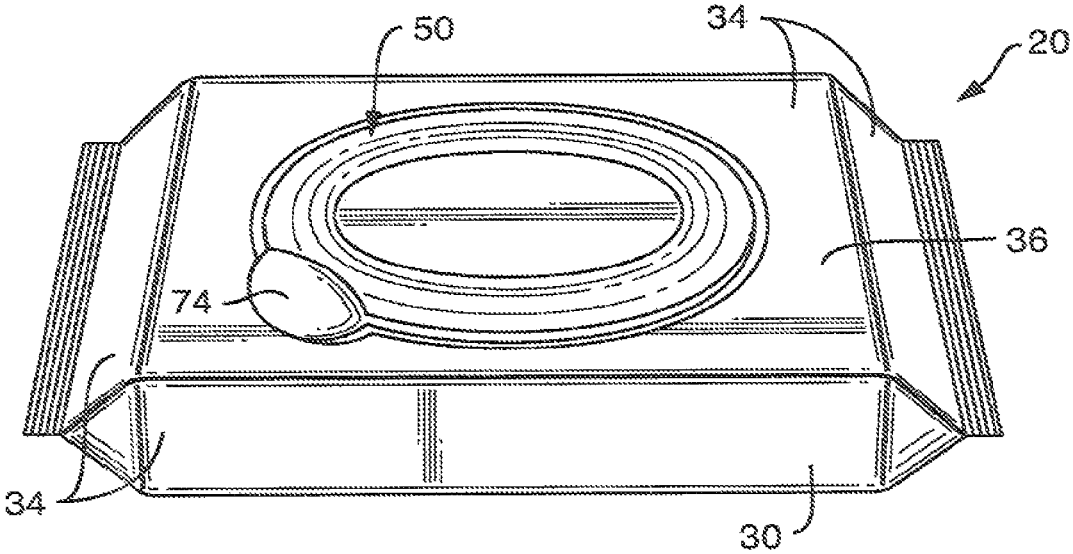
FIG. 5 representatively shows a top view of the example of FIG. 4.

The rigid flip top 50 includes a lid 52 connected to a flange 54 by a hinge 56, as representatively illustrates in FIGS. 6-10. The flange 54 is affixed to an outer surface 38 of the pouch at the top portion 36 of the pouch 30 such that the rigid flip top 50 overlies the removable portion 40 of the pouch and such that the removable portion 40 is surrounded by the flange 54 at the outer surface 38 of the pouch 30. The rigid flip top 50 may be located partially on or entirely affixed to only the top portion 36, or a portion of it may also be affixed to a side portion 34. The flange 54 can optionally include strengthening ribs 55 around the flange to stiffen the flange as desired, as representatively illustrates in FIGS. 8 and 18. The lid 52 is removably positionable to be closed (e.g., as seen in FIGS. 4 and 5) to engage the flange 54 and thereby seal the pouch at the outer surface where the removable portion 40 is surrounded by the flange 54 and covered by the lid 52, and to thus seal the pouch 30 and product 22 therein from the environment outside the pouch 30 after the removable portion 40 is removed and no further wipes are desired during a particular dispensing occasion. The lid 52 can include an annular sealing ring 51 that extends downward from the inside of the lid and that is sized to fit against an annular sealing ring 53 extends upward from the inside of the flange (FIGS. 8 and 18), to assist in better sealing the lid 52 to the flange 54 when the lid 52 is closed.

Figure 6:
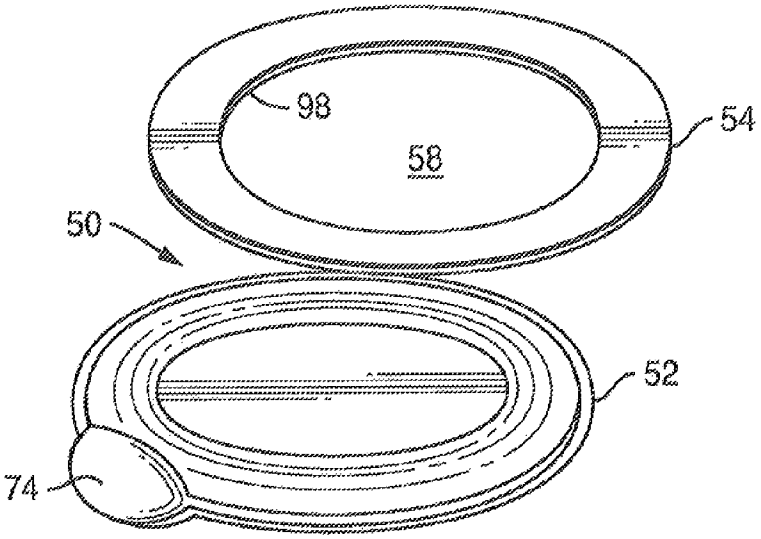
FIG. 6 representatively shows a bottom view of the rigid flip top, with the lid and the flange laid open flat to present the outside of the rigid flip top (i.e., as would be seen from underneath if the lid in FIG. 4 would be moved to a second open position (that is, a fully open position relative to the container), and without the pouch connected to the flange).

Referring to FIGS. 6 and 9, the flange 54 defines an interior region 58 through which the product can be dispensed when the lid 52 is opened. The interior region 58 is the region bordered by the ring, oval, rectangle, or other shape defined by the interior edge 98 of the flange 54. The interior region 58 has an interior region length 57, an interior region width 59, and an interior region area 61. (The length 57 and width 59 are respectively equal to the length and width of the smallest rectangle that can be formed around the interior region 58.) The interior region 58 contains the removable portion 40 of the pouch 30, as well as a non-removable portion 44 of the pouch 30. That is, the flange 54 frames the interior region 58, and the removable portion 40 and the non-removable portion 44 together fill the interior region 58.

In particular embodiments, the removable portion area 42 is no greater than 80%, more preferably no greater than 70%, and still more preferably no greater than 60% of the interior region area 61. In particular embodiments, such as those depicted in FIGS. 8A and 9, the removable portion area 42 is no greater than 70% and no less than 30% of the interior region area.

Figure 8A:
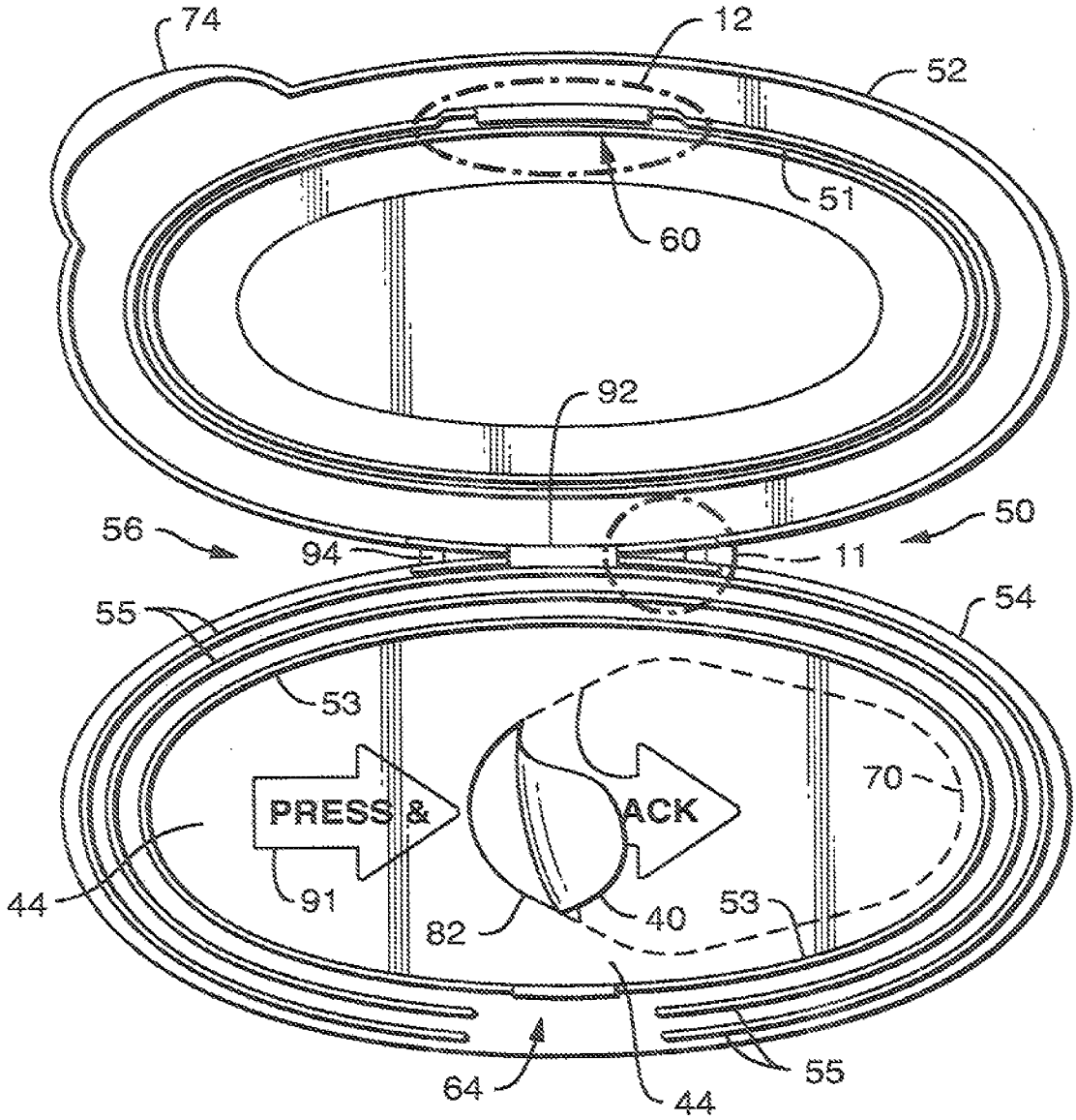
FIG. 8A representatively shows an enlarged top view of the rigid flip top, with the lid and the flange laid open flat to see the inside of the rigid flip top (i.e., as would be seen if the lid in FIG. 4 would be moved to a second open position, that is, a fully open position relative to the container), and showing the structure and graphics of the top portion of the underlying pouch, with removable portion intact.
Figure 8B:
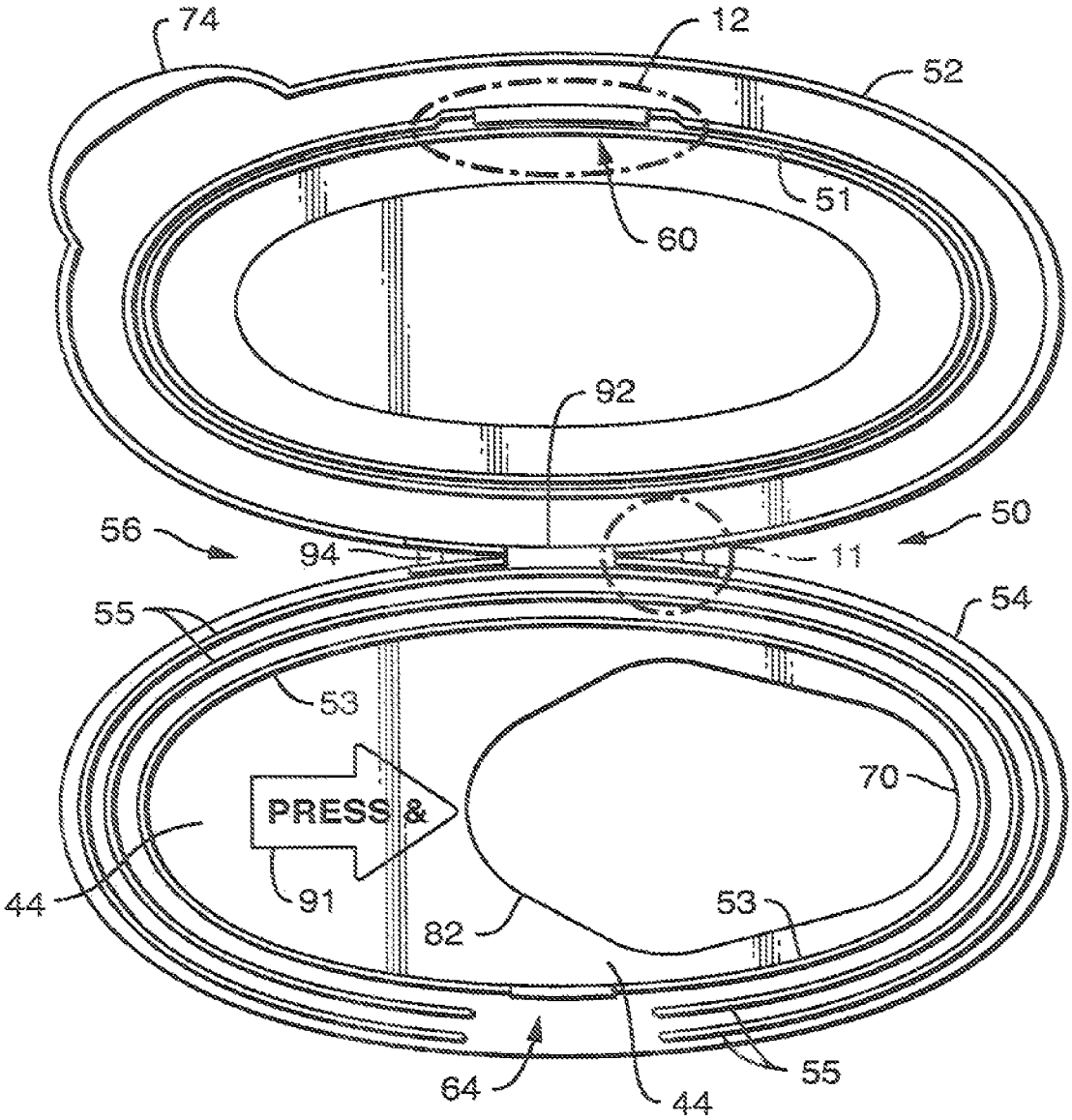
FIG. 8B representatively shows the same view as FIG. 8B, but with the removable portion removed.
Figure 10A:
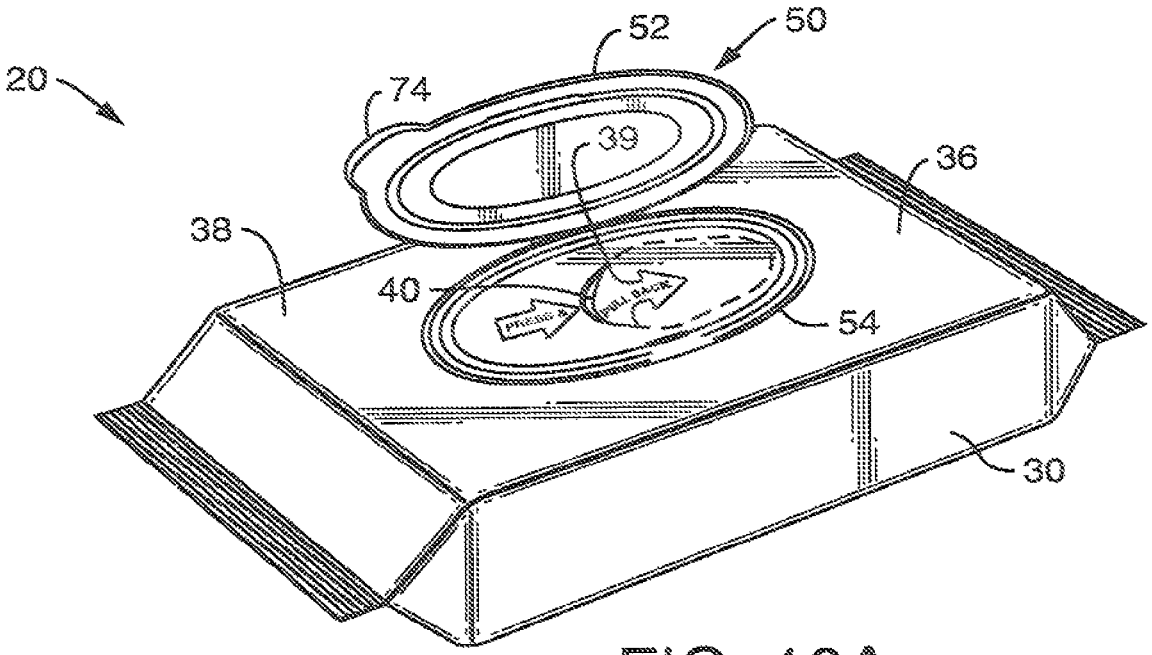
FIGS. 10A-10C representatively show three exemplary stages of removing the removable portion of the top portion of the pouch.

Furthermore, as representatively illustrates in FIGS. 8, 9, and 10A, the removable portion 40 abuts the flange at an apex 70. "Abuts" as used herein means disposed within five (5) millimeters of the referenced structure. "Apex" as used herein means the location along the removable portion perimeter 41 that is generally the last to release from the pouch when the removable portion is pulled off in accordance with the instructions (i.e., the terminus of the tearing operation). The apex could be positioned on a curved line segment, a straight line segment, at the intersection of two line segments, or other desired configuration. In particular embodiments, the removable portion 40 is disposed within four (4) millimeters, and still more particularly with three (3) millimeters of the flange 54. In particular embodiments, not only does the removable portion 40 abut the flange 54 at an apex 70, but at least 30% and more particularly at least 50% of the perimeter 41 of the removable portion 40 abuts the flange 54. In addition, in certain embodiments, at least 25% of the perimeter of the removable portion does not abut the flange (that is, at least 25% of the perimeter is at least 6 millimeters from the flange). For example, in the embodiment of FIGS. 8 and 9, approximately 60% of the removable portion abuts the flange, and approximately 40% of the removable portion does not abut the flange. By limiting the removable portion area 42 relative to the interior region area 61 and by positioning the thus-limited removable portion 40 as just described, at least two benefits can in particular embodiments be achieved. First, it has been discovered that by disposing opening-instructional elements both inside of and outside of the removable portion 40, the clarity and intuitiveness of the opening mechanism can be improved for the user. By placing a cap on the removable portion area 42 relative to the interior region area 61, enough room is provided in the interior region 58 (that is, within the area surrounded by the flange 54) for all of the necessary instructional graphic elements. Second, it has been discovered that when the relative area of the removable portion is capped as described, positioning the removable portion 40 too far from the flange is problematic, because when the tearing operation associated with pulling off the removable portion 40 reaches the tear apex 70, an unintended tear can propogate into the non-removable portion 44 of the interior region 58. By taking steps to abut the tear apex 70 to the flange 54, this unintended tear propogation can in particular embodiments be minimized or eliminated.

Referring to FIG. 9, a bisecting line 86 extends in the direction of the width 59 at a midpoint of the length 57 to divide the interior region 58. In particular embodiments, at least 60%, more particularly at least 70%, and still more particularly at least 80% of the removable portion area 42 is located on one side of this bisecting line 86. By positioning the removable portion 40 "off center" in this manner, additional space can be provided in the interior region 58 for improved functionality of various instructional graphic elements relative to the position of the removable portion 40. Furthermore, such "off center" positioning of the removable portion 40 can in particular embodiments help to reduce, minimize, or eliminate unintended propagation of tears in the non-removable region as described earlier, by virtue of the removable portion 40 now being pushed far enough to one side to cause the tear apex 70 to abut the flange 54.

In particular embodiments, printed opening-instructional graphics 90 are disposed on the outer surface 38 in the interior region 58. The purpose of the opening-instructional graphics 90 is to illustrate and/or describe to a user how to properly remove the removable portion 40 from the pouch 30. The opening-instructional graphics 90 include a first instructional graphic 91 disposed on the non-removable portion 44 and a second instructional graphic 93 disposed on the removable portion 40. For example, in the printed opening-instructional graphics 90 representatively illustrates in FIGS. 8 and 9, the first instructional graphic 91 includes an arrow outline surrounding the word "PRESS," and the second instructional graphic 93 includes an arrow outline surrounding the words "PULL BACK." In particular embodiments, the first instructional graphic 91 communicates a first opening step, and the second instructional graphic 93 communicates a second opening step, and the first opening step is adapted to occur before the second opening step. For example, in the embodiment of FIGS. 8 and 9, the first instructional graphic 91 is positioned to the left of the second instructional graphic 93, and the first instructional graphic 91 includes an ampersand. The second instructional graphic 93 is positioned to the right of the first instructional graphic 91, and the ampersand within the first instructional graphic 91 sits between the word "PRESS" and the words "PULL BACK." These factors collectively communicate that the "PRESS" step should be completed before the "PULL BACK" step. Alternatively, the numeral "1" could be included in the first instruction graphic 91, and the numeral "2" could be included in the second instructional graphic 93. Thus, the first instructional graphic 91 communicates a first opening step and the second instructional graphic communicates a second opening step, and the first opening step (in the illustrated example, the "PRESS" step) is adapted to occur before the second opening step (in the illustrated example, the "PULL BACK" step). In the example illustrated in FIGS. 8 and 9, the arrow of the first instructional graphic 91 is pointed at the removable portion 40, and the first instructional graphic 91 instructs a user to press the removable portion 40. Also, in the illustrated example, the arrow of the second instructional graphic 93 is pointed at the tear apex 70, and the second instructional graphic 93 instructs a user to pull the removable portion 40 toward the tear apex 70. In the illustrated example, the second instructional graphic 93 employs an arrow and the words "PULL BACK" to instruct the user to pull the removable portion toward the tear apex 70. Other examples include the use of a finger or hand graphic depicted as pulling the removable portion 40 up and to the right toward the apex 70, or other combination of suitable images or words.

Figure 10B:
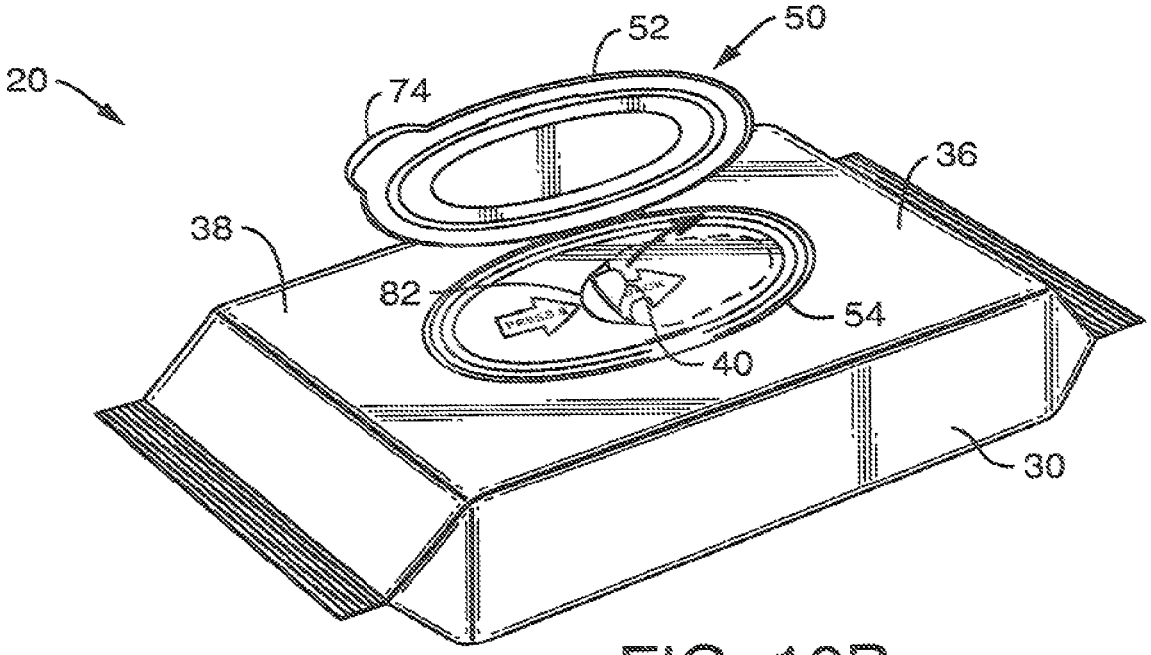
Figure 10C:
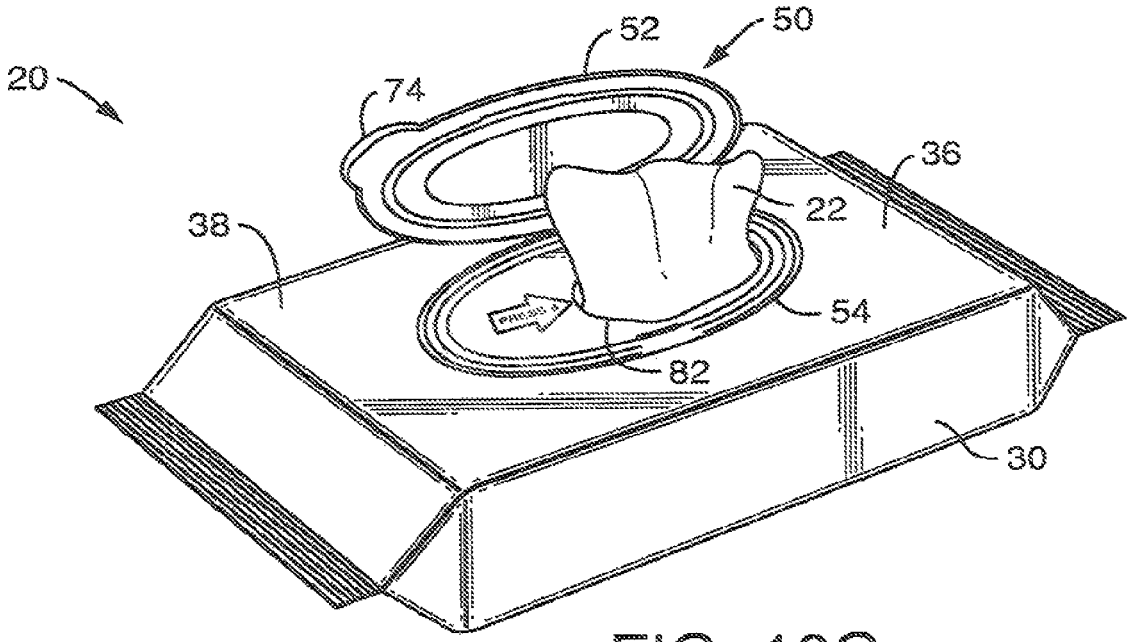
Figure 11:
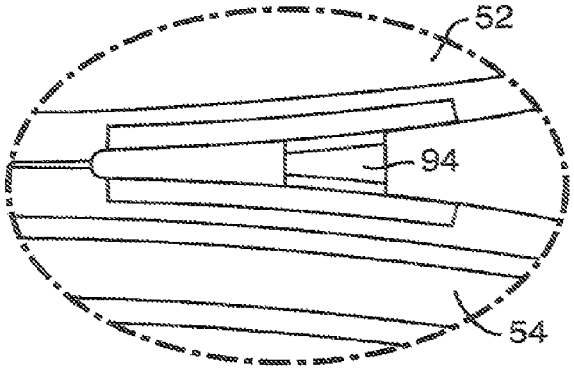
FIG. 11 representatively shows an enlarged view of the circled portion 11 seen in FIG. 8.

FIGS. 10A-10C representatively illustrate various stages of removing the removable portion 40 to reveal the dispensing orifice 82. In all of FIGS. 10A-10C, the lid 52 is shown in an open position. In FIG. 10A, the removable portion 40 is depicted as it might appear immediately following the operation of a first opening step, such as a "PUSH" step. In the illustrated example, the frangible line of weakness 39 has been broken in the left-most section of the perimeter 41 of the removable portion 40. In FIG. 10B, the removable portion 40 is depicted as it would appear during the operation of a second opening step, such as a "PULL" or "PULL BACK" step. In the illustrated example, the frangible line of weakness 39 continues to be broken in the direction of the tear apex 70. Finally, in FIG. 10C, the removable portion 40 has been entirely removed and is no longer present, and a wipe 22 is shown in a pop-up, ready-to-grasp configuration.

Figure 9A:
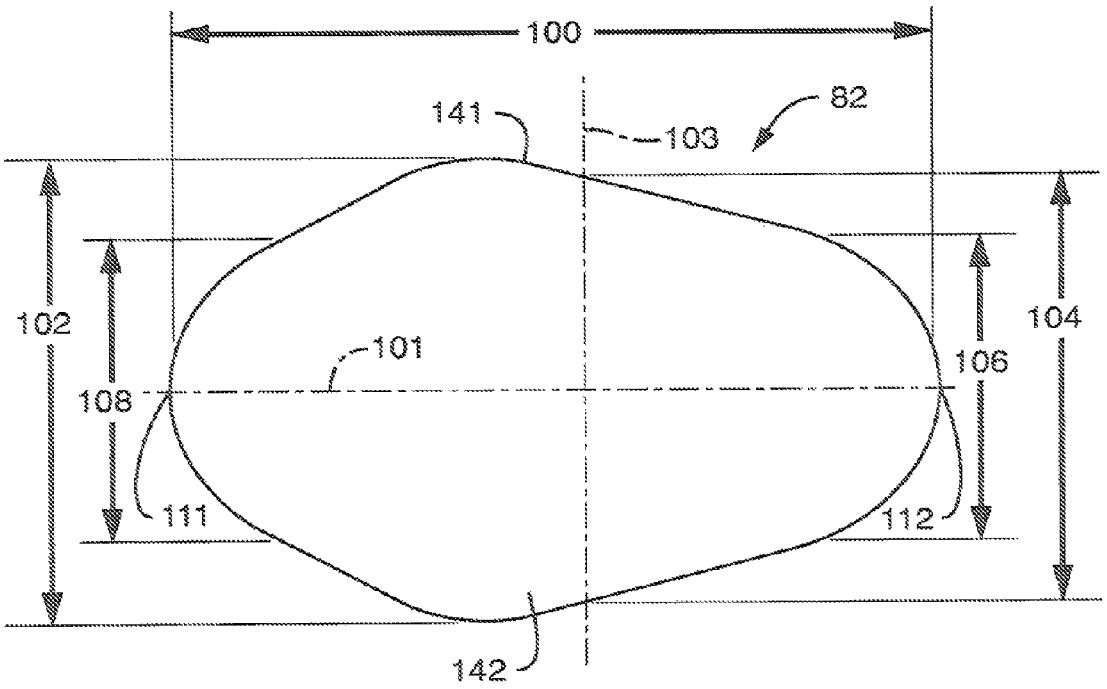
FIG. 9A is a representative illustration of a dispensing orifice incorporating certain principles of the present invention.

Referring to FIGS. 9 and 9A, the dispensing orifice 82 has a length 100, a maximum width 102, a midpoint width 104, a third width 106, and a fourth width 108. The length 100 extends along a longitudinal axis 101 from a first end 111 to a second end 112. Each width dimension 102/104/106/108 extends perpendicularly to the length dimension 100. "Maximum width" as used herein means the width at a location along the length that is greater than any other width measured at any other location along the length. "Midpoint width" as used herein means the width measured at a position halfway between the first end 111 and the second end 112 of the orifice 82—that is, the width as measured halfway along the length 100. "Third width" as used herein means the width measured at a position 80% of the way from the first end 111 to the second end 112. "Fourth width" as used herein means the width measured at a position 20% of the way from the first end 111 to the second end 112.

In particular embodiments, the maximum width 102 is disposed not less than 20%, more particularly not less than 25%, and still more particularly not less than 27% of the distance from the first end to the second end. In particular embodiments, the maximum width 102 is disposed not more than 49%, more particularly not more than 45%, still more particularly not more than 40%, and still more particularly not less than 38%. In a particular embodiment, the maximum width 102 is disposed approximately 33% of the distance from the first end 111 to the second end 112.

The midpoint width 104 is less than the maximum width 102. In particular embodiments, the midpoint width 104 is no greater than 95% of the maximum width 102, and/or the midpoint width 104 is no less than 85% of the maximum width 102. The third width 106 is no greater than 80% and more particularly no greater than 70% of the maximum width 102. Furthermore, in particular embodiments, the third width 106 is no less than 50% and more particularly no less than 60% of the maximum width 102. The fourth width 108 is no greater than 80% and more particularly no greater than 70% of the maximum width 102. Furthermore, in particular embodiments, the fourth width 108 is no less than 50% and more particularly no less than 60% of the maximum width 102.

The dispensing orifice 82 defines a perimeter 141 and an area 142. In particular embodiments, straight line segments form at least 15% and more particularly at least 20% of the perimeter 141.

In particular embodiments, the length 100 of the dispensing orifice 82 is at least 45 millimeters and at most 55 millimeters, and in particular embodiments is approximately 50 millimeters. In particular embodiments, the maximum width 102 of the dispensing orifice 82 is at least 30 millimeters and at most 40 millimeters, and in particular embodiments is approximately 35 millimeters. In particular embodiments, the area 142 of the orifice 82 is at least 11 and more particularly at least 12 square centimeters, and is at most 15 and more particularly at most 14 square centimeters, and in particular embodiments is between 12.5 and 13 square centimeters. In particular embodiments, product 22 is comprised of a plurality of sheets, and each sheet has an area. In particular embodiments, the area 142 of the orifice 82 is at least 8% and more particularly at least 9% of the area of each sheet of product, and the area 142 of the orifice 82 is at most 14% and more particularly at most 13% of the area of each sheet or product. In a particular embodiment, the area 142 of the orifice 82 is approximately 11% of the area of each sheet of product.

In particular embodiments, the dispensing orifice 82 has an ovoid shape. Also, in particular embodiments, a transverse axis 103 is disposed halfway between the first end 111 and the second end 112 and extends perpendicularly to the longitudinal axis 101, and the dispensing orifice 82 is symmetrical about the longitudinal axis 101 asymmetrical about the transverse axis 103. Preferably, though not necessarily, the dispensing orifice 82 has no points of inflection anywhere along its perimeter 141.

In identifying the optimal efficacy of dispensing orifices having the dimensions and shapes just described, the inventors tested a variety of commercially available and prototype dispensing orifices. Each commercially available container of which the inventors are aware includes a dispensing orifice that is symmetrical about both its longitudinal axis and its transverse axis, in contrast to particular orifice embodiments of the present invention. Furthermore, the relatively less optimal prototypes tested by the inventors included symmetrical ovals and symmetrical diamonds. Based on this testing, dispensing orifices having the features set forth in the paragraphs above and in the claims below were deemed to be superior to commercially available orifices and to various experimental prototypes. Without wishing to be bound by any theory, it is believed that orifices as described in the paragraphs above have superior efficacy due in particular embodiments to (1) their overall size relative to the sheet being pulled through them; (2) their length; (3) a maximum width wide enough to allow a plurality of adult human fingers to reach into the container; and (4) offsetting the maximum width from the longitudinal midpoint of the dispensing orifice to allow the opposite side to be more narrowed or necked so as to better maintain trailing wipes in a "pop-up" position. Thus, the unique and inventive combination of orifice features described above delivers an optimum balance of reach-in access, "multiples"-prevention, and "pop-up"-position retention.

Figure 12:
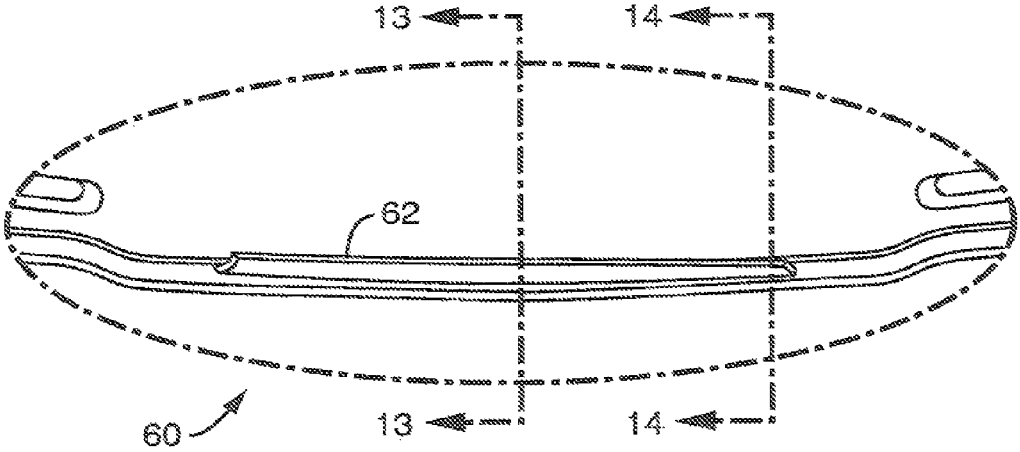
FIG. 12 representatively shows an enlarged view of the circled portion 12 seen in FIG. 8.
Figure 13:
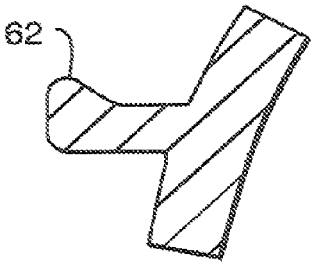
FIG. 13 representatively shows an enlarged cross-sectional view of a portion of the latch of the lid seen in FIG. 12, taken along the line 13-13.
Figure 14:
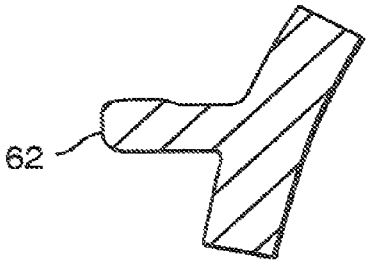
FIG. 14 representatively shows an enlarged cross-sectional view of a portion of the latch of the lid seen in FIG. 12, taken along the line 14-14.
Figure 15:
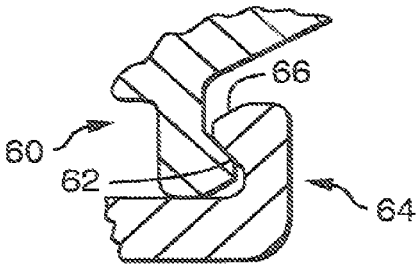
FIG. 15 representatively shows an enlarged cross-sectional view of a portion of the rigid flip top seen in FIG. 4, taken along the line 15-15, and is also an enlarged view of the circled portion 15 seen in FIG. 16.
Figure 16:
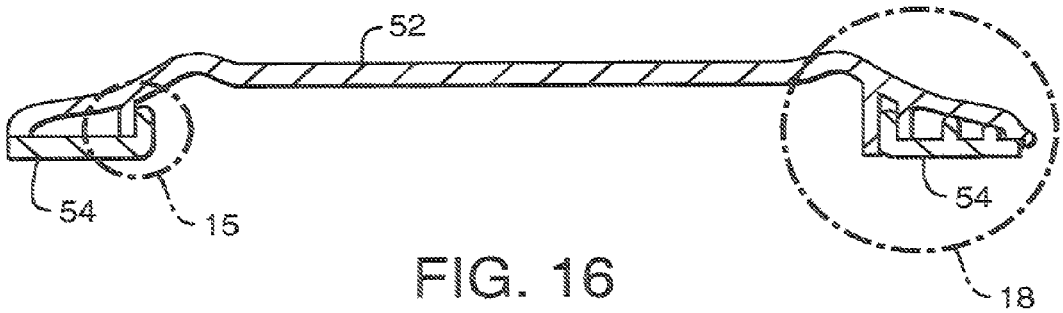
FIG. 16 representatively shows a cross-sectional view of the rigid flip top seen in FIG. 4, taken along the line 16-16.
Figure 17:
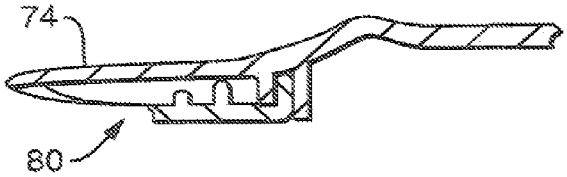
FIG. 17 representatively shows a cross-sectional view of a portion of the rigid flip top seen in FIG. 19, taken along the line 17-17.
Figure 18:
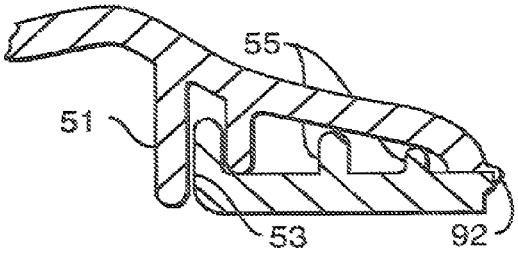
FIG. 18 representatively shows an enlarged cross-sectional view of the circled portion 18 seen in FIG. 16.
Figure 19:
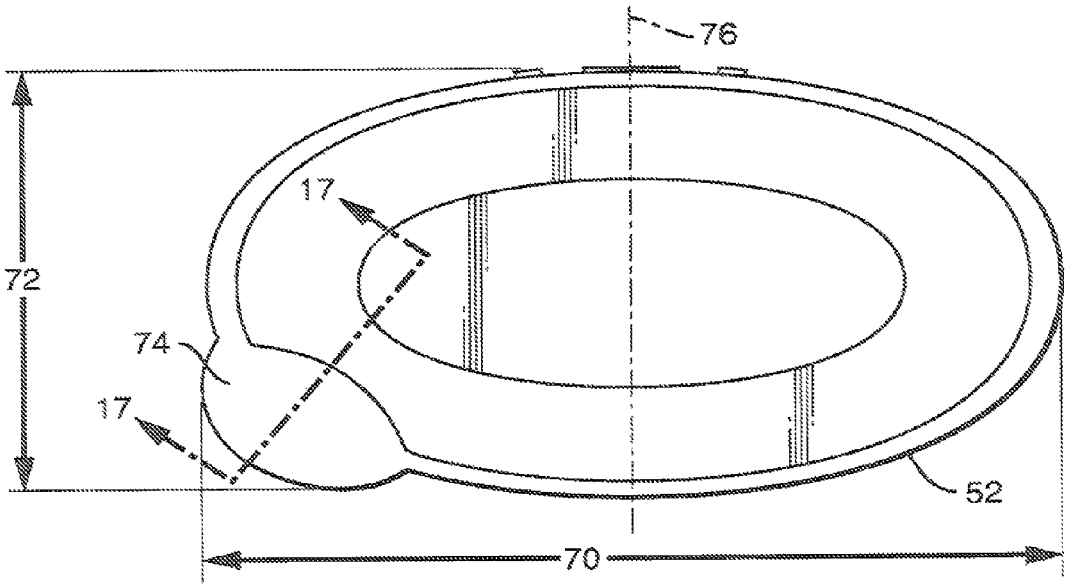
FIG. 19 representatively shows a top view of a rigid flip top suitable for use in conjunction with particular embodiments of the present invention.

Referring to FIGS. 8 and 12-15, the lid can include a latch 60 with an elongate first rib 62 projecting horizontally therefrom, and the flange 54 can include a catch 64 with an elongate second rib 66 projecting horizontally therefrom. The first and second ribs 62 and 66, respectively, can removably engage each other in an interference fit to maintain the lid closed (e.g., as seen in FIG. 15) and removably disengage each other when the lid is opened. In particular embodiments, at least one of the first and second ribs 62 and 66, respectively, has a non-uniform elongate cross-section (i.e., the non-uniform cross-section being determined along the length of the rib). Such non-uniformity is seen as one example in FIGS. 12-14. In this way, e.g., a gradual decreasing interference (i.e., due to thickness and/or amount of horizontal projection) of the rib profile provides less material on one side of the latch (e.g., the right side in FIG. 12) to thereby reduce the force needed to overcome the interference fit relationship with the rib on the catch. As seen in FIG. 12, approximately halfway along the length of the latch, the rib 62 is of uniform elongate cross-section which enables, if desired, an audible click to signal complete closure of the lid upon the flange. Another advantage of this non-uniform rib design is that a unique latch/catch relationship is created that enables the latch to peel away from the catch as the opening tab 74 flexes the lid toward the open position, so that a user does not have to overcome the entire latch/catch interference fit at one time to disengage the two members.

The non-uniformity of the rib 62 and/or 66 could further be defined as an angled (e.g., tapered) elongate cross-section, as seen in detail in FIGS. 13-15. Alternatively, or additionally, the elongate first rib 62 of the latch 60 can project inward (e.g., as seen in FIGS. 12 and 15) relative to a perimeter of the lid in a horizontal plane of the lid and the elongate second rib 66 of the catch 64 can project outward (e.g., as seen in FIG. 15) relative to a perimeter of the flange in a horizontal plane of the flange. Still alternatively, or additionally, the first rib 62 can have a non-uniform elongate cross-section and the second rib 66 can have a uniform elongate cross-section.

Referring to FIGS. 5, 6, 8, and 19, in particular embodiments, the lid 52 includes an opening tab 74. The "opening tab" is defined herein as any portion of the lid that projects radially out from the lid away from the sealing portion of the rigid flip top and thereby enables a user to place at least one fingertip between the projecting portion and the flexible pouch to assist in separating the lid from the flange when moving the lid to the open position. The opening tab 74 protrudes from the rigid flip top 50 so that a user can more easily grasp it and have a more identifiable leverage point to open the lid. In particular embodiments, the opening tab 74 can be placed off-center (e.g., left or right of a centrally positioned bisecting line 76, or alternatively, a tab left and a second tab right of bisecting line 76), and particularly at least 60%, and more advantageously at least 70%, at least 80%, at least 90%, and most advantageously, as shown in FIGS. 5, 6, 8, and 19, 100% so located.

The opening tab 74 can include a pocket 80 (e.g., FIG. 17) located between the opening tab 74 and the outer surface adjacent thereto, which aids a user in grasping the lid when opening it. The lid may be of a substantially uniform simple geometric shape (e.g., circle, oval, triangle, square, rectangle, pentagon, hexagon, septagon, etc.) except for the optional opening tab 74 projecting outwardly of the lid perimeter.

Figure 7:
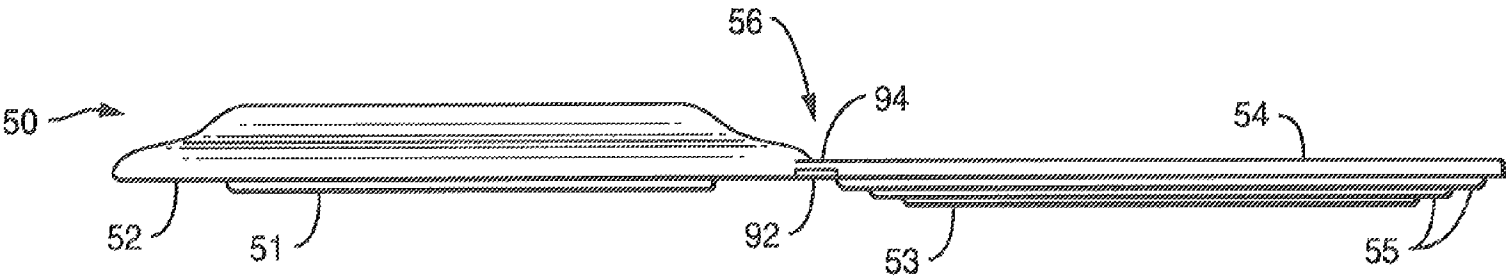
FIG. 7 representatively shows a right side view of the rigid flip top in a fully open, flat orientation.

In particular embodiments, referring to FIGS. 7 and 8, the rigid flip top 50 include a hinge 56. The hinge can be a living hinge, where "living hinge" means a hinge formed integrally with the members it is between, such as between the lid 52 and the flange 54. The hinge can include a central strap 92 and a pair of toggle straps 94, with each toggle strap 94 located on an opposite side of the central strap 92. In particular embodiments, the hinge enables the lid to move throughout a first open position (e.g., from about 0 degrees defined relative to a horizontal plane, to at least about 90 degrees defined relative to the same horizontal plane). Then, moving the lid past the first open position requires overcoming a force (i.e., a stress release point anywhere from about 90 degrees defined relative to the same horizontal plane to about 180 degrees defined relative to the same horizontal plane) created by the central strap and the pair of toggle straps, and when the force is overcome, the lid is maintained in a second open position (i.e., anywhere past the stress release point, e.g., about 135 degrees relative to the same horizontal plane which would then allow the lid to further open about another 30 degrees), and thereby the lid in the second open position is at an arc greater than the arc of the lid in the first open position. To move the lid from the second open position to a closed position requires that the force be overcome in a direction reverse that when moving the lid from the first open position to the second open position. The "affixed" relationship of the rigid flip top 50 to the pouch 30 can be by various mechanical and chemical methods known in the art, including, but not limited to, use of glue or other bonding material, thermal bonding or welding, ultrasonic bonding or welding, or other joining methods as long as they create a permanent joined relationship between the pouch 30 and the rigid flip top 50. The rigid flip top can be made by a variety of conventional techniques, including, for example, injection molding.

The pouch 30 of the present invention can be made from various materials and in various configurations. The pouch can be made of polyester film laminated to polyethylene film. The polyester film can be reverse printed, so the printing is between the two film layers. Alternatively, a single-ply surface printed film can be used. A single-ply film can be composed of one or more layers of polyolefin and in particular embodiments formed in a coextrusion.

The product, e.g., wipes or wet wipes, can be arranged in the pouch in any manner which provides convenient and reliable one at a time dispensing and which assists the wipes in not becoming dirty and/or overly dry. For example, the wipes may be arranged in a dispenser or container as a plurality of individual sheets arranged in a stacked configuration to provide a stack of wipes which may or may not be individually folded. The wipes may be individual wipes which are folded in a c-fold, z-fold, quarter fold or other zigzag fold or interfolded or non-interfolded configurations as are known to those skilled in the art. The product 22 may include a plurality of wipes stacked one on top of each other in a non-interfolded configuration, for "reach-in" dispensing. For such a non-interfolded wipe, each wipe is folded onto itself with no portion of another wipe being positioned between or underneath any portion of the folds of the adjacent wipe(s). These configurations for wipes, as well as those discussed herein, may be provided by means known to those skilled in the art.

Alternatively, the individual wipes can be interfolded or in other ways related such that the leading and trailing end edges of successive wipes in the stacked configuration overlap, for "pop-up" dispensing. In such a configuration, the leading end edge of the trailing wipe is loosened from the stack by the trailing end edge of the leading wipe as the leading wipe is removed by the user. The wipes can be interfolded to facilitate such dispensing by means known to those skilled in the art.

Yet alternatively, the wipes can be arranged in the pouch as a continuous web of interconnected wipes which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. The portion of the web of material between successive lines of frangibility provides each individual wipe. The lines of frangibility can be provided by means known to those skilled in the art such as perforations, indentations, or cuts in the web of material. For example, the lines of frangibility or perforations can be provided in the web of material by passing the web of material between a die cutter roll and anvil roll. After the lines of frangibility have been incorporated into the web of material, the web can then be arranged in a stacked configuration for easy insertion into the pouch during formation thereof.

The container of the present invention can include any suitable number of individual wipes depending upon the desired packaging and end use. For example, the container can be configured to include a stack of wipes which can include at least about 5 wipes and desirably from about 8 to about 320 individually wipes, and more desirably from about 16 to about 64 wipes. The size and shape of the stack of wipes is dependent upon the size and shape of the container and vice versa.

Each wipe is in particular embodiments generally rectangular in shape and defines a pair of opposite side edges and a pair of opposite end edges which can be referred to as a leading end edge and a trailing end edge. The leading end edge of each wet wipe is typically positioned in the pouch to be grasped by a user to facilitate a removal of the wipe from the container.

Materials suitable for the wipes of the present invention are well known to those skilled in the art. For wet wipes, these can be made from any material suitable for use as a moist wipe, including meltblown, coform, air-laid, bonded-carded web materials, hydroentangled materials, high wet-strength tissue and the like, and can comprise synthetic or natural fibers or combinations thereof. The wipes of the different aspects of the present invention can contain a liquid which can be any solution which can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances, or combinations thereof. The liquid can also contain lotions, ointments, and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe for improved wiping.

As with the other packages of the invention, the pouch and/or rigid flip top can be transparent or translucent to provide an indication of the quantity of wipes remaining in the container. The pouch and/or rigid flip top can be made of various polymers, copolymers, and mixtures, including, e.g., polyethylene, polypropylene, polyester, polystyrene, and other polymers.

Accordingly, the different aspects and features of the present invention can provide containers for wipes which, when compared to conventional containers for wipes, provide improved ease-of-opening, improved pouch tear prevention, and/or improved wipe dispensing. While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims.

What is claimed is:

1. A storing and dispensing container for a plurality of sheets of product, the container comprising:

a housing for storing product, the housing comprising a bottom portion with side portions adjoined to the bottom portion and each side portion adjoined to an adjacent side portion and the side portions extending away from the bottom portion, the side portions also adjoined to a top portion with the top portion overlying the bottom portion and being generally parallel to the bottom portion, the plurality of sheets of product being positioned within the housing; and a dispensing orifice in the top portion, the dispensing orifice having a length extending along a longitudinal axis from a first end to a second end, the dispensing orifice having:

a maximum width disposed not less than 20% and not more than 49% of the distance from the first end to the second end;

a midpoint width disposed halfway between the first end and the second end, the midpoint width being less than the maximum width; and a third width disposed 80% of the distance from the first end to the second end, the third width being no greater than 80% of the maximum width;

wherein the housing comprises a flexible pouch, and wherein the top portion includes a removable portion which seals the product within the pouch in a first condition and which allows access to the product within the pouch in a second condition, the removable portion defining a perimeter and having a removable portion area, the container further comprising:

a rigid flip top comprising a lid connected to a flange by a hinge, the flange being affixed to an outer surface of the pouch at the top portion of the pouch such that the rigid flip top overlies the removable portion of the pouch and the removable portion is surrounded by the flange at the outer surface of the pouch, the flange defining an interior region through which the product can be dispensed when the lid is opened and the lid being removably positionable to be closed to engage the flange and thereby seal the pouch at the outer surface where the removable portion is surrounded by the flange, the interior region having an interior region length, an interior region width that extends from a hinge-side of the flange to a side of the flange opposite the hinge, and an interior region area, the interior region containing the removable portion and a non-removable portion, wherein the removable portion area is no greater than 80% of the interior region area, and wherein the removable portion abuts the flange at a tear apex, wherein at least 70% of the removable portion area is located on one side of a bisecting line that extends parallel to the interior region width at a midpoint of the interior region length.

2. The container of claim 1, wherein the maximum width is disposed not less than 25% and not more than 40% of the distance from the first end to the second end.

3. The container of claim 1, wherein the maximum width is disposed not less than 27% and not more than 38% of the distance from the first end to the second end.

4. The container of claim 1, wherein the maximum width is disposed approximately 33% of the distance from the first end to the second end.

5. The container of claim 1, wherein the midpoint width is no greater than 95% and no less than 85% of the maximum width.

6. The container of claim 1, the third width being no less than 60% of the maximum width.

7. The container of claim 1, wherein the dispensing orifice further has a fourth width disposed 20% of the distance from the first end to the second end, the fourth width being no greater than 80% of the maximum width.

8. The container of claim 7, the fourth width being no less than 50% of the maximum width.

9. The container of claim 1, wherein the dispensing orifice defines a perimeter, and wherein straight line segments comprise at least 15% of the perimeter.

10. The container of claim 1, wherein the length of the dispensing orifice is at least 45 millimeters and at most 55 millimeters.

11. The container of claim 1, wherein the maximum width of the dispensing orifice is at least 30 millimeters and at most 40 millimeters.

12. The container of claim 1, wherein the maximum width of the dispensing orifice is approximately 35 millimeters.

13. The container of claim 1, wherein an area of the dispensing orifice is between 12.5 and 13 square centimeters.

14. The container of claim 1, wherein each sheet has an area, and wherein an area of the dispensing orifice is at least 8% and at most 14% of the area of each sheet.

15. The container of claim 11, wherein the area of the dispensing orifice is approximately 11% of the area of each sheet.

16. A storing and dispensing container for a plurality of sheets of product, the container comprising:

a housing for storing product, the housing comprising a bottom portion with side portions adjoined to the bottom portion and each side portion adjoined to an adjacent side portion and the side portions extending away from the bottom portion, the side portions also adjoined to a top portion with the top portion overlying the bottom portion and being generally parallel to the bottom portion, the plurality of sheets of product being positioned within the housing; and a dispensing orifice in the top portion, the dispensing orifice having:

a length extending along a longitudinal axis from a first end to a second end, the length defining a longest dimension of the dispensing orifice; and a transverse axis disposed halfway between the first end and the second end and extending perpendicularly to the longitudinal axis, wherein the dispensing orifice is symmetrical about the longitudinal axis but asymmetrical about the transverse axis, wherein the housing comprises a flexible pouch, and wherein the top portion includes a removable portion which seals the product within the pouch in a first condition and which allows access to the product within the pouch in a second condition, the removable portion defining a perimeter and having a removable portion area, the container further comprising:

a rigid flip top comprising a lid connected to a flange by a hinge, the flange being affixed to an outer surface of the pouch at the top portion of the pouch such that the rigid flip top overlies the removable portion of the pouch and the removable portion is surrounded by the flange at the outer surface of the pouch, the flange defining an interior region through which the product can be dispensed when the lid is opened and the lid being removably positionable to be closed to engage the flange and thereby seal the pouch at the outer surface where the removable portion is surrounded by the flange, the interior region having an interior region length, an interior region width that extends from a hinge-side of the flange to a side of the flange opposite the hinge, and an interior region area, the interior region containing the removable portion and a non-removable portion, wherein the removable portion area is no greater than 80% of the interior region area, and wherein the removable portion abuts the flange at a tear apex, wherein at least 70% of the removable portion area is located on one side of a bisecting line that extends parallel to the interior region width at a midpoint of the interior region length.

* * * * *